US007964082B2

(12) United States Patent
Tong

(10) Patent No.: US 7,964,082 B2
(45) Date of Patent: Jun. 21, 2011

(54) METHOD FOR ELECTROPHORETIC COATING

(75) Inventor: Peng-Cheng Tong, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 1063 days.

(21) Appl. No.: 11/752,901

(22) Filed: May 23, 2007

(65) Prior Publication Data

US 2008/0105547 A1 May 8, 2008

(30) Foreign Application Priority Data

Nov. 3, 2006 (CN) ..... 2006 1 0063470

(51) Int. Cl.
*C25D 5/56* (2006.01)

(52) U.S. Cl. ..... 205/165; 205/166; 205/167; 205/169

(58) Field of Classification Search ..... 205/164–169
See application file for complete search history.

(56) References Cited

U.S. PATENT DOCUMENTS 4,714,535 A * 12/1987 Coombes et al. ..... 204/297.06

* cited by examiner

*Primary Examiner* — Kishor Mayekar
(74) *Attorney, Agent, or Firm* — Jeffrey T. Knapp

(57) ABSTRACT

An exemplary electrophoretic coating method and an electroplated shell (800) manufactured thereby is provided. The electrophoretic coating method includes the following steps. A first step (Step S1) is to mold a base shell (500). The base shell includes a base body (50), a shell body (60), and a connecting body (70). The shell body and the connecting body are molded with the base body. The connecting body connects with the shell body. A second step (Step S2) is to pretreat the shell body and the connecting body. Thus, conducting films are formed on the shell body and connecting body. A third step (Step S3) is to electrophoretically coat the preliminarily treated base shell, so as to form electroplated layers on the shell body. A fourth step (Step S4) is to remove the connecting body so as to form/yield the electroplated shell.

7 Claims, 4 Drawing Sheets

METHOD FOR ELECTROPHORETIC COATING

BACKGROUND OF THE INVENTION

1. Field of the Invention The present invention relates to a method for electroplating and, particularly, to a method for electroplating a shell with at least two unconnected shell portions that need to be electroplated.

2. Description of Related Art

Nowadays, portable electronic devices (e.g., mobile phones and digital cameras) are desirably fashionable. Therefore, shells or enclosures of the portable electronic devices are often decorated using various kinds of surface treatment. An electroplating technology is typically implemented as a surface treatment technology to provide the shell with a metallic brightness so as to realize an aesthetic appearance.

Generally, some portions of the shells of the portable electronic devices are not connected together for sake of structural design. The unconnected portions are typically electroplated and are attached to the base of the shell by means of ultrasonic bonding technology or hot-melt (e.g. plastic welding) technology.

However, the above electroplating method includes a number of steps whereby each unconnected portion needs a separate procedure to apply the electroplating. Thus, the above multi-step electroplating method is costly and time consuming. In addition, the color and brightness of each unconnected portions can vary, potentially to a relatively great extent, so as to lead to an inconsistent overall coating. Thus, the desired aesthetic appearance of the body of the shell is necessarily not achieved.

What is needed, therefore, is a method for electroplating that can overcome the above-mentioned shortcomings.

SUMMARY

In one aspect thereof, an electroplating method for manufacturing an electroplated shell is provided. The electroplating method includes the following steps. The first step is to mold a base shell. The base shell includes a base body, a shell body, and a connecting body. The shell body and the connecting body are molded with the base body. The connecting body connects (i.e., is linked) with the shell body. The second step is to pretreat the shell body and the connecting body, in order to form respective conducting films on the shell body and connecting body. The third step is to electrophoretic coat the preliminarily treated base shell, so as to form electroplated layers on the shell body. The last step is to remove the connecting body, so as to form the electroplated shell.

Other advantages and novel features will become more apparent from the following detailed description, when taken in conjunction with the accompanying drawings.

BRIEF DESCRIPTION OF THE DRAWINGS

Many aspects of a method for electroplating can be better understood with reference to the following drawings. These drawings are not necessarily drawn to scale, the emphasis instead being placed upon clearly illustrating the principles of the present method for electroplating. Moreover, in the drawings like reference numerals designate corresponding parts.

DETAILED DESCRIPTION OF PREFERRED EMBODIMENTS

The present method for electroplating is suitable for coating a base shell, e.g., of portable electronic devices, such as mobile phones or digital cameras and so on. In this preferred embodiment, an exemplary base shell of a mobile phone is presented.

Figure 1:
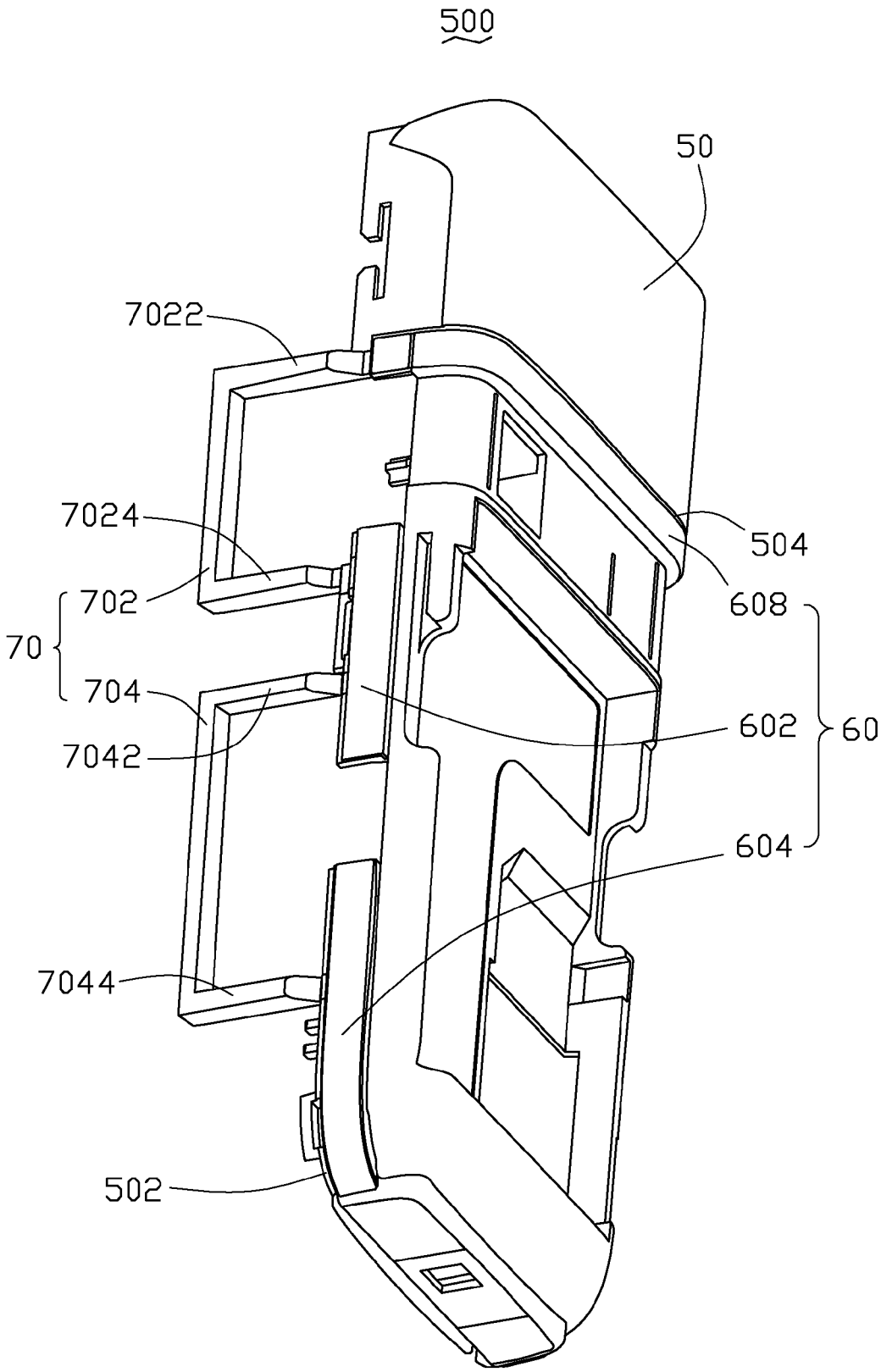
FIG. 1 is an isometric view of a base shell, in accordance with a preferred embodiment, showing one aspect of the base shell.
Figure 2:
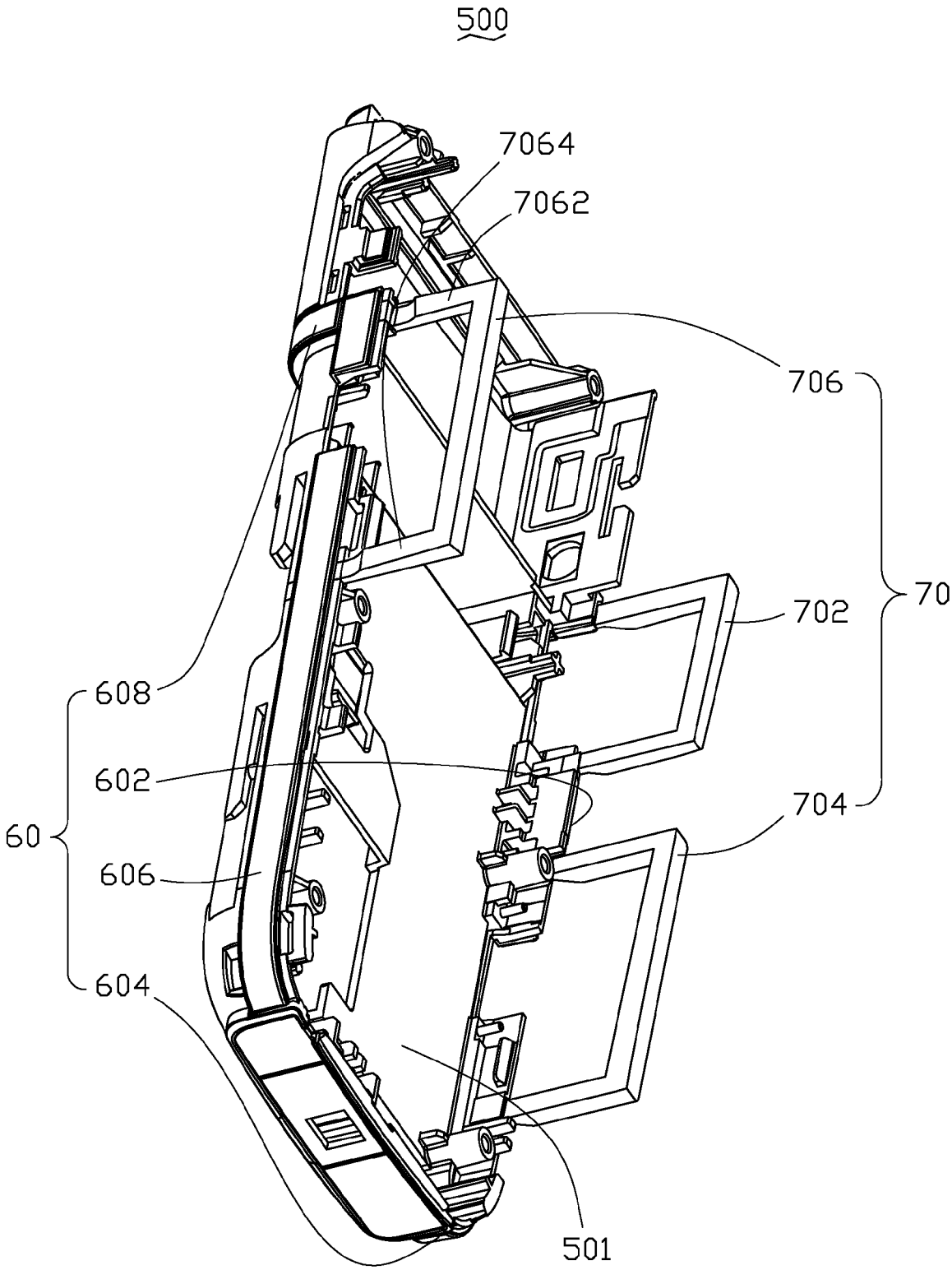
FIG. 2 is another isometric view of the base shell shown in FIG. 1, showing another aspect of the base shell.

Referring to the drawings in detail, FIGS. 1 and 2 show the exemplary base shell 500. The base shell 500 is manufactured to form a shell 800 (shown in FIG. 3) for use in the mobile phone, implementing the electroplating method (shown in FIG. 4).

With reference to FIGS. 1 and 2, the base shell 500 includes a generally a rectangular-shaped base body 50, a shell body 60, and a connecting body 70. The shell body 60 is formed on the base body 50. The connecting body 70 is usefully formed in a manner so, as to directly connect with the shell body 60, and, as such, the connecting body 70 is configured (i.e., structured and arranged) for aiding the electroplating the base shell 500. The shell body 60 includes a plurality of unconnected shell portions, and the connecting body 70 includes a plurality of connecting portions. In this embodiment, the shell body 60 includes a first shell portion 602, a second shell portion 604, a third shell portion 606, and a fourth shell portion 608. The connecting body 70 includes a first connecting portion 702, a second connecting portion 704, and a third connecting portion 706. The shell portions 602, 604, 606, 608 are separated from each other and are interconnected by the respective connecting portions 702, 704, 706.

The first, second and third shell portions 602, 604, 606 are preferably integrally formed on a relatively longer exterior wall 502 of the base body 50. The first and second shell portions 602, 604 are located at a same side of the base body 50. The third shell portion 606 is positioned opposite to the first and second shell portions 602, 604. The fourth shell portion 608 is preferably integrally formed on a relatively shorter exterior wall 504 of the base body 50. Two opposite ends of the fourth shell portion 608, respectively, extend downwardly to connect/adjoin with the relatively longer exterior wall 502.

Referring to FIG. 2 again, the first, second and third connecting portions 702, 704, 706 are preferably the same in structure. Each connecting portion is, in the illustrated example, generally an unenclosed rectangular frame with an opening therethrough. Two ends of the connecting portion form the opening. Specifically, the first connecting portion 702 includes two ends 7022 and 7024, the second connecting portion 704 includes two ends 7042 and 7044, and the third connecting portion 706 includes two ends 7062 and 7064.

The first, second and third connecting portions 702, 704, 706, respectively, connect to an adjacent pair of the first, second, third and fourth shell portions 602, 604, 606, and 608. The first, second, and third connecting portions 702, 704, 706 are located in a same direction extending downwardly from the relatively longer exterior wall 502. The first and second connecting portions 702, 704 are located at a same side of the base body 50. The third connecting portion 706 is positioned opposite to the first and second connecting portions 702, 704.

The first connecting portion 702 connects with the first shell portion 602 and the fourth shell portion 608. Two ends

7022, 7024 of the first connecting portion 702 respectively connect with the fourth shell portion 608 and the first shell portion 602. The second connecting portion 704 connects the first shell portion 602 and the second shell portion 604. Two ends 7042, 7044 of the connecting portion 704 respectively connect with the first shell portion 602 and the second shell portion 604. The third connecting portion 706 connects with the third shell portion 606 and the fourth shell portion 608. Two ends 7062, 7064 of the third connecting portion 706 respectively connect with the fourth shell portion 608 and the third shell portion 606.

Figure 3:
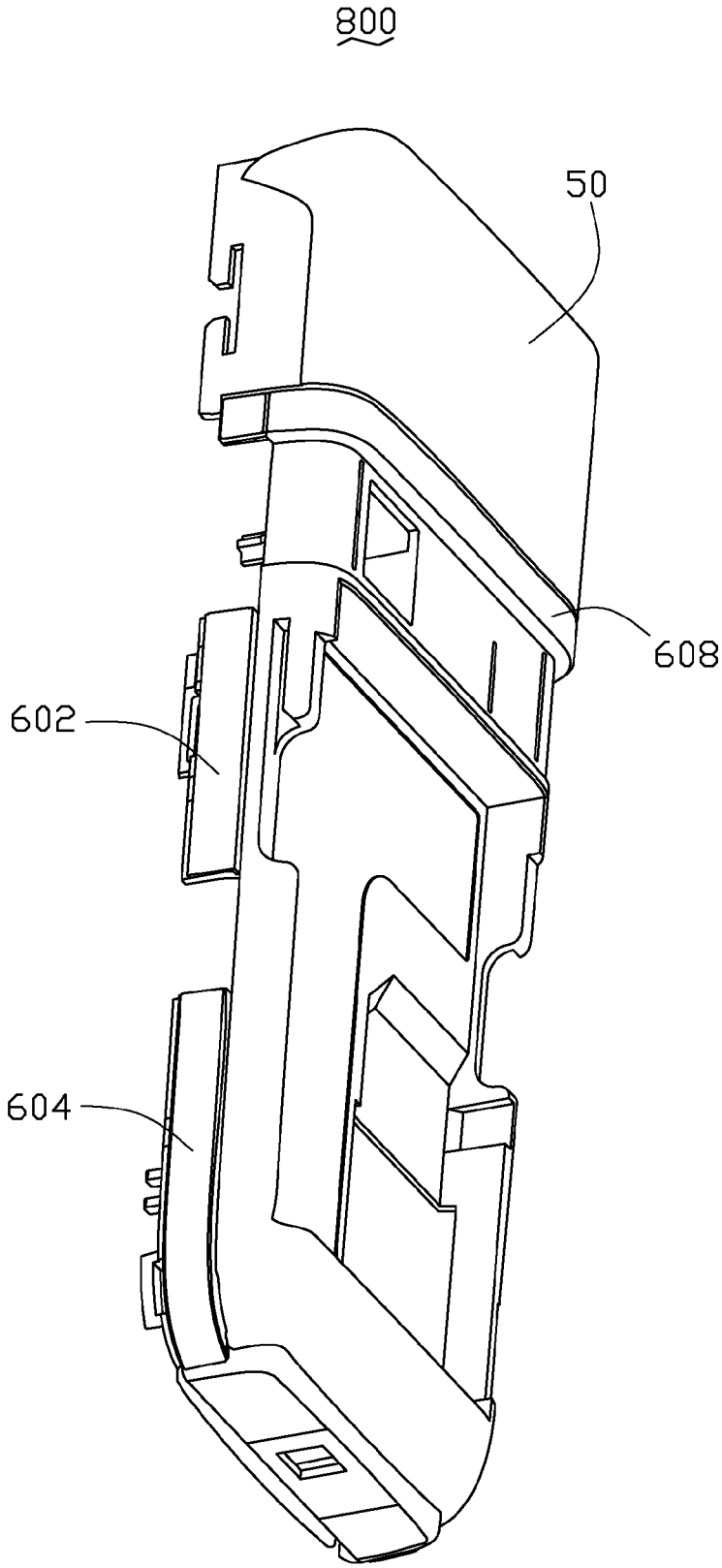
FIG. 3 is an isometric view of a shell manufactured from the base shell, shown in FIG. 1.
Figure 4:
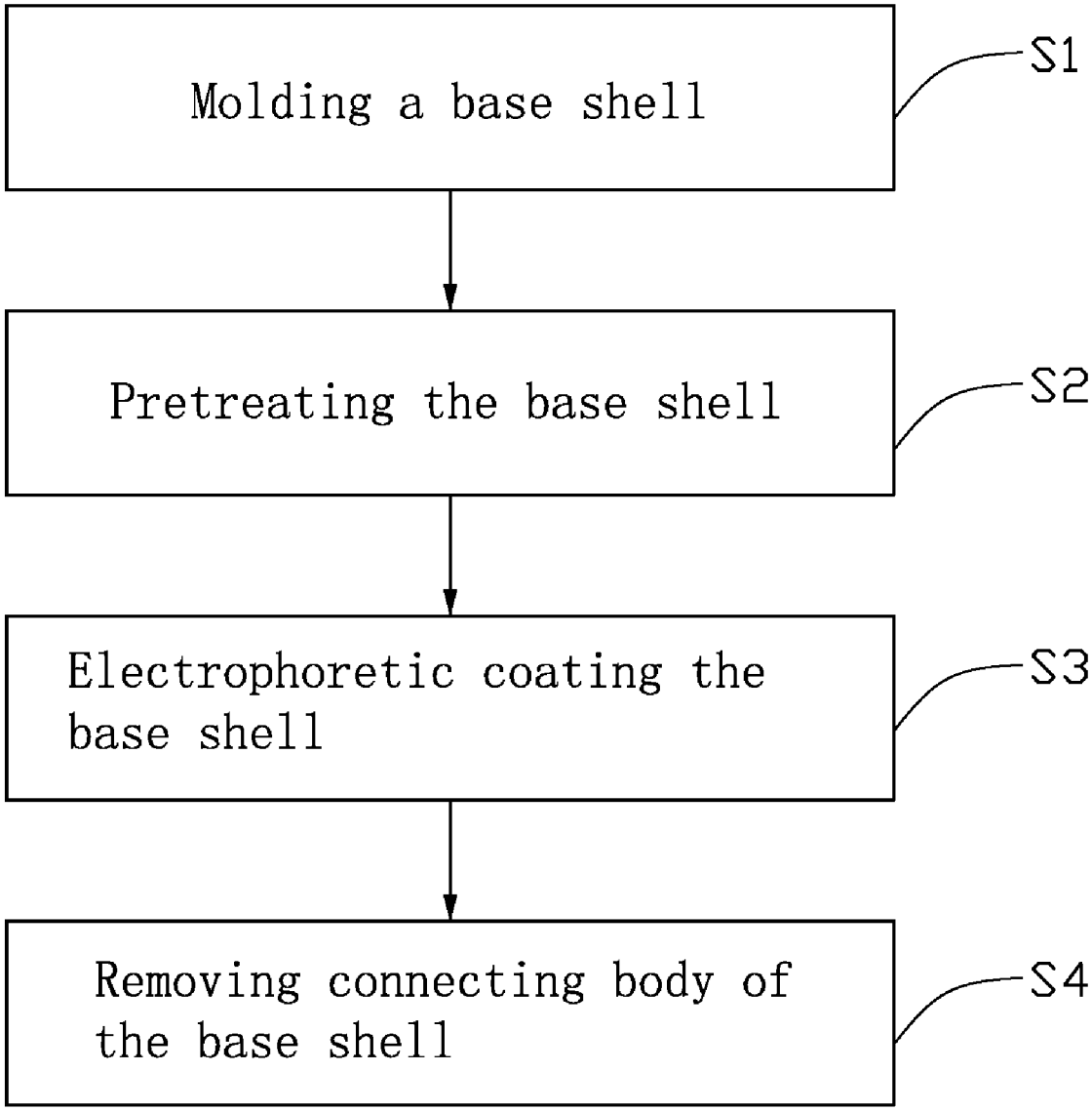
FIG. 4 is a flow chart of an electroplating method for manufacturing the shell shown in FIG. 3 from the base shell shown in FIG. 1.

Referring now to FIG. 4, a method for electroplating the base shell 500, so as to form the shell (shown in FIG. 3) is as follows:

Step S1 is implemented to mold-to-form the base shell 500. Specifically, the base body 50, the shell body 60, and the connecting body 70 are preferably insert-molded, as a whole. The shell body 60 and the connecting body 70 are beneficially made of particular material, which is easy to be electroplated, e.g. ABS material (Acrylonitrile-Butadiene-Styrene). The base body 50 is beneficially, however, formed by different material from that of the shell body 60 and the connecting body 70, which cannot be electroplated, PC material (polyethylene glycol).

After that, Step S2 is implemented to pretreat the base shell 500. Firstly, surfaces of the base shell 500 are washed with an alkaline solution (e.g., NaOH or $Na_2CO_3$), so as to remove, e.g., grease, dirt, and/or impurities. Secondly, surfaces of the shell body 60 are roughened, e.g., by a grit blast method. Thus, an adhesive force achievable between electroplated layers and the shell body 60 is enhanced (i.e., roughening effectively increases the local surface area of the shell body 60, and the overall adhesive force increases with increasing bonding area).

Generally stated, the electroplated layers are formed on the shell body 60 by a process of electroplating, and the particular following steps are used to prepare the shell body 60 for that process. Thirdly, the base shell 500 is immersed into a sensitizing solution, e.g., stannous chloride solution, allowing surfaces of the shell body 60 and the connecting body 70 to form adsorption layers of an oxidizable metallic material, e.g., stannous oxide. Fourthly, the sensitized base shell 50 is immersed into an activating solution, e.g., Palladium Chloride solution. As such, the surfaces of the shell body 60 and the connecting body 70 have noble metal films formed thereon. Finally, the activated base shell 50 is immersed into a copper sulfate solution, so as to deposit a continuous copper layer on the all surfaces/sections of the shell body 60 and the connecting body 70. Thus, metallic conducting films are concurrently and continuously formed on the surfaces of the shell body 60 and the connecting body 70.

After that, Step S3 is implemented to electrophoretic coat the preliminarily treated base shell 500. The base shell 500 is firmly hung by means of the first and third connecting portions 702, 706, respectively, using a jig. The jig connects with a negative electrode and then is immersed into an electroplating bath with electroplating solution (e.g., copper coating solution or chrome coating solution). A metallic rod connecting with a corresponding positive electrode is also immersed into the electroplating solution to start the electroplating. The surfaces of the shell body 60 and the connecting body 70, all previously covered with one or more metallic conducting films. The presence of the continuous metallic conducting films, extending over all the surfaces, allows conductance to all portions of the shell body 60 and the connecting body 70 and, thus, permits all such surfaces thereof to be electroplated. Thus, the shell body 60 and the connecting body 70 are electroplated in the electroplating solution, so as to concurrently form electroplated layers on all surfaces/sections of the shell body 60 and the connecting body 70. By concurrently forming such electroplated layers, the problems associated with the prior art are essentially avoided.

Finally, Step S4 is implemented to remove the connecting body 70 of the electroplated base shell 500 to form/yield the shell 800 (shown in FIG. 3). The shell 800 is thereby electroplated with even/consistent metallic brightness.

The main advantages of the present embodiment are as the following. After the pretreatment of the base shell 500, the conducting connecting portions 702, 704, 706 interconnect with the conducting unconnected shell portions 602, 604, 606, 608. In the Process of electroplating, the shell portions 602, 604, 606, 608 and the connecting portions 702, 704, 706 can be electroplated at one time. Thus, the electroplating process is simplified because there is no need to electroplate the shell portions 602, 604, 606, 608 individually. Furthermore, the shell portions 602, 604, 606, 608 can be provided with an identical effect of electroplating, such as metallic brightness, since such shell portions 602, 604, 606, 608 are concurrently coated (i.e., no difference, e.g., in coating material and/or coating time (factors that could influence, for example, brightness)) in the present process. In addition, because the connecting body 70 is used to hang the base shell 500 on the jig, there is no need to add any extra hanging device. Thus, manufacturing cost is decreased.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electroplating method for manufacturing an electroplated shell, the coating method comprising the following steps:

molding a base shell, the base shell including a base body, a shell body, and a connecting body, the shell body and connecting body being molded with the base body, the shell body comprising unconnected shell portions, the connecting body comprising connecting portions, the connecting portions connecting the shell portions, enabling the unconnected shell portions to be indirectly connected as a unit, the shell body and the connecting body made of a material that can be electroplated, the base body made of another material that cannot be electroplated, the material for the shell body and the connecting body being different from the material for the base body;

pretreating the shell body and the connecting body to yield conducting films covering the shell body and connecting body;

electroplating the shell body and the connecting body to concurrently form electroplated layers on the shell body and the connecting body; and removing the connecting body to form the electroplated shell.

2. The electroplating method as claimed in claim 1, wherein the shell portions include a first shell portion, a second shell portion, a third shell portion, and a fourth shell portion, the connecting portions include a first connecting portion, a second connecting portion, and a third connecting portion, the first, second, third, and fourth shell portions are separated from each other and are interconnected by the first, second and third connecting portions, respectively.

3. The electroplating method as claimed in claim 1, wherein in the step of molding the base shell, the base shell is molded as a whole, and the base body, the shell body, and the connecting body are integrated as a whole.

4. The electroplating method as claimed in claim 1, wherein the pretreating of the shell body and connecting body comprises a a washing procedure, a surface roughening procedure, a sensitizing procedure, an activating procedure, and a depositing procedure.

5. The electroplating method as claimed in claim 1, wherein during the step of electrophoretic coating, the base shell is hung by a jig attached to the connecting body.

6. The electroplating method as claimed in claim 1, wherein the shell body and the connecting body are made of ABS (Acrylonitrile-Butadiene-Styrene) material.

7. The electroplating method as claimed in claim 6, wherein the base body is made of PC (Polycarbonate) material.

* * * * *